US006817415B2

(12) United States Patent
Orban et al.

(10) Patent No.: US 6,817,415 B2
(45) Date of Patent: Nov. 16, 2004

(54) METHOD OF SEALING AN ANNULUS SURROUNDING A SLOTTED LINER

(75) Inventors: Jacques Orban, Garches (FR); Claude Vercaemer, London (GB); Erik Nelson, Sugar Land, TX (US); Dominique Guillot, Fontenay-aux-Roses (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 112 days.

(21) Appl. No.: 10/289,184

(22) Filed: Nov. 5, 2002

(65) Prior Publication Data

US 2004/0084184 A1 May 6, 2004

(51) Int. Cl.[7] ..... E21B 33/13
(52) U.S. Cl. ..... 166/292; 166/285; 166/66.5
(58) Field of Search ..... 166/285, 292, 166/293, 66.5

(56) References Cited

U.S. PATENT DOCUMENTS 2,696,260 A * 12/1954 Fast ..... 166/66.5
4,244,424 A * 1/1981 Talbot ..... 166/66
4,691,774 A 9/1987 Nelson
4,802,536 A 2/1989 Larson et al.
5,259,452 A * 11/1993 Wittrisch ..... 166/250.01
5,697,441 A 12/1997 Vercaemer et al.
6,250,848 B1 * 6/2001 Moridis et al. ..... 405/263
6,390,196 B1 * 5/2002 Montaron et al. ..... 166/290
2003/0224056 A1 * 12/2003 Kotha et al. ..... 424/489

FOREIGN PATENT DOCUMENTS

EP 0 621 247 10/1994

* cited by examiner

*Primary Examiner*—David Bagnell
*Assistant Examiner*—T. Shane Bomar
(74) *Attorney, Agent, or Firm*—Thomas O. Mitchell; Robin Nava; Brigitte J. Echols

(57) ABSTRACT

A method of sealing an annulus surrounding a slotted liner in a well includes the steps of generating a magnetic field in the annulus in a region to be sealed; and injecting into the region a sealing fluid including magnetic particles such that the fluid is confined to fill the annulus in the region to be sealed by the interaction of the magnetic particles and the magnetic field.

10 Claims, 2 Drawing Sheets

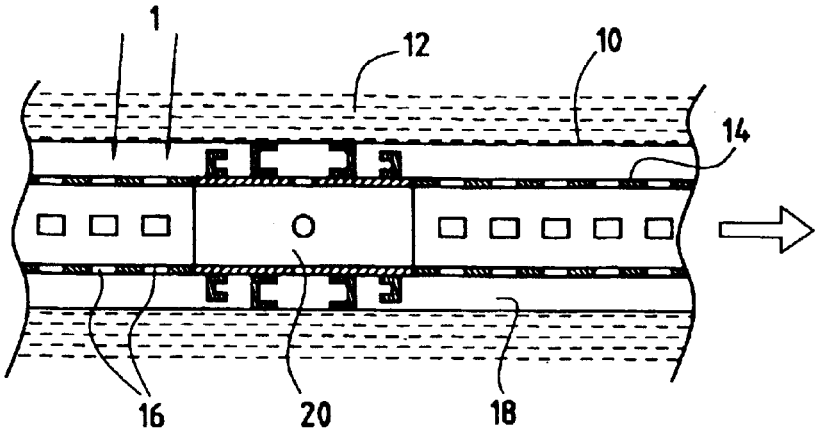
FIG.1
FIG.2A
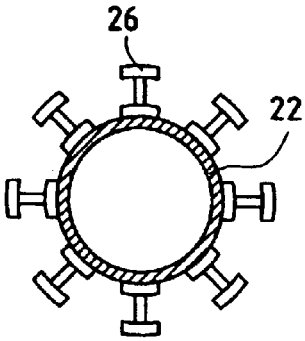
FIG.2B
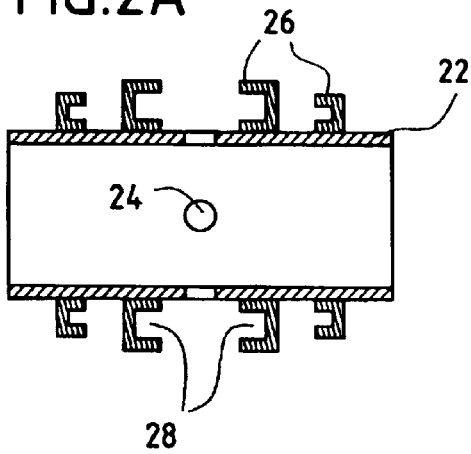
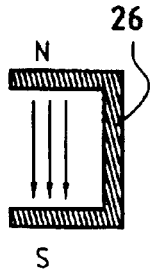
FIG.2C
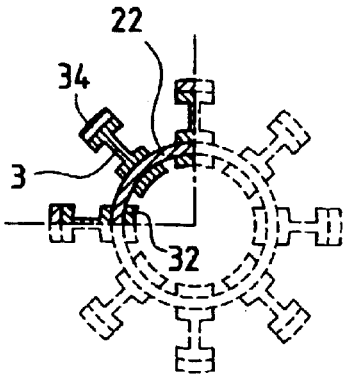
FIG.3B
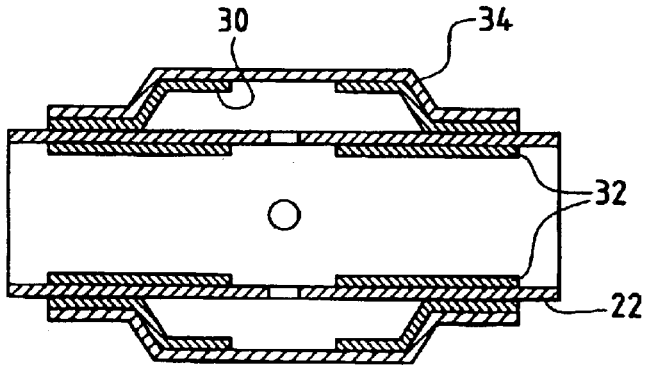
FIG.3A

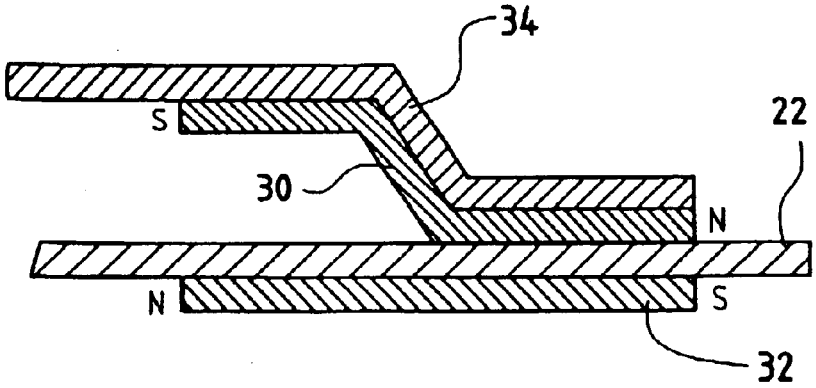
FIG.3C
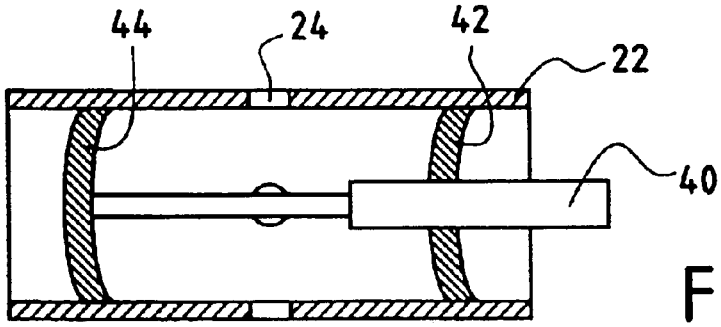
FIG.4
FIG.5
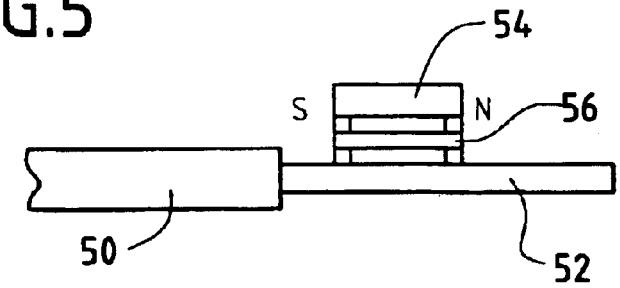

METHOD OF SEALING AN ANNULUS SURROUNDING A SLOTTED LINER

FIELD OF THE INVENTION

The present invention relates to techniques for placing external casing packers (ECP) outside slotted liners. In particular, the invention relates to chemical external casing packers (CECP) for such a purpose.

BACKGROUND OF THE INVENTION

In traditional well completions, a casing, typically made of steel, is positioned in the well and the annulus between the casing and the well filled with cement. Fluid communication between the reservoir and the well is usually achieved by perforating the casing and the cement sheath using an explosive charge inside the casing so as to create a fluid communication path. Fluid flow along this path can be enhanced or stimulated by fracturing and/or placement of proppant or the like. However, this method of completion is not necessary the most economical for particular well types, especially horizontal producing sections. In such cases, slotted liners can be used as completion devices when formation characteristics are adequate. Slotted liners are installed without cementing leaving the annulus free for fluid communication, the liner being held in place by centralizers or the like. This completion method can allow optimized production, as flow cross-section near the well bore can be maximized.

One of the main problems of this completion is the difficulty to isolate some sections of the well during production as may be required when one section of the well produces an unwanted fluid (i.e. water). A conventional approach to prevent unwanted flow from a zone in a traditional completion would consist of installing a valve (or a bridge plug) in the well bore to stop fluid from flowing to the zone below that device. However with slotted liner, this isolation within the well bore is ineffective, as fluid can flow in around the device by the annulus outside the slotted liner.

To ensure proper isolation, it is therefore necessary to plug the annulus in the area of the valve or plug. This isolation can be achieved by external casing packer (ECP). Typically, this is a device with an external rubber membrane installed between slotted liner sections, while running the liner in the well. When required, this rubber membrane can be inflated with cement to plug the annulus. This isolation process is often inadequate and the rubber often cannot seal properly against the formation. In some case, the rubber membrane is damaged during the installation and cannot inflate properly.

Another technique for annular isolation is based on chemical injected in the annulus at the proper position as is described in U.S. Pat. No. 5,697,441. The chemical needs to have the proper properties to block the annular flow, for example having thixotropic properties to develop a yield strength to resist the shear force generated by the formation fluid in the annulus. It can also be arranged to set to become hard (such as cement). The main problem with the chemical external casing packer (CECP) is the improper filling of the annulus which can arise for different reasons, for example:

Gravity can lead to some segregation of the chemical in the annulus.

Even with the best adjustment of viscosity, it is rare that the chemical will flow in the annulus to ensure full coverage of the annulus (the fluid will tend to follow the path of least resistance) and there is no real mechanism to force the fluid to progress in a radial direction towards the formation and fill the annulus.

In practice, CECP's often leak but they do have the advantage that they can be installed at any position in the slotted liner.

The use of magnetic cement slurries, spacers, etc. has been previously proposed in U.S. Pat. Nos. 4,691,774 and 4,802,534. Magnetic particles are incorporated in the fluids to make them susceptible to manipulation by magnetic fields. In particular, this is used to obtain a scrubbing action in the well to remove deposits remaining in the well when the cement is placed which would otherwise prevent a good cement bond from forming. The manipulation of the fluids is achieved by means of a device placed inside the casing which creates an oscillating magnetic field in the location of the magnetic fluid.

The present invention utilizes the properties of magnetic fluids to improve the performance of CECP's.

SUMMARY OF THE INVENTION

In accordance with a first aspect of the invention, there is provided a method of sealing an annulus surrounding a slotted liner in a well, comprising: generating a magnetic field in the annulus in a region to be sealed; and injecting into the region a sealing fluid comprising magnetic particles such that the fluid is substantially confined to fill the annulus in the region to be sealed by the interaction of the magnetic particles and the magnetic field.

Preferably, the magnetic field is generated by means of magnets positioned on the outside of the liner and/or inside the liner, adjacent the region to be sealed. The magnets can be positioned on either side of the region to be sealed to confine the sealing fluid therebetween.

Magnets on the outside of the casing can comprise, for example, opposed horseshoe magnets positioned on either side of the region. Multiple rows of magnets can be used if desired.

Where magnets are positioned inside the liner, it is particularly preferred that these be moveable within the liner. In such cases, it is preferred to provide an external magnet structure, for example an apparent pole typically made from a high mu metal (a metal having a high value of magnetic permeability) or a rare-earth magnetic material (eg. Sm—Co, Nd—Fe,—B). When the magnet is positioned inside the liner near the external magnet structure, the two together define a "horseshoe" structure. The external magnet structure can conveniently be located inside a centralizer spring.

In accordance with a second aspect of the invention, there is provided a slotted liner for a well, comprising: injection ports for injecting a fluid including magnetic particles into the annulus surrounding the liner; and at least one magnet for generating a magnetic field around the injection ports so as to confine the fluid to fill the annulus around the injection ports.

One preferred embodiment has at least one pair of opposed rows of horseshoe magnet structures positioned on the outside of the liner. These can comprise permanent magnets, or external magnet structures which cooperate with a magnet inside the liner to generate the magnetic field.

Where an external magnet structure is used, it is preferably formed from a high-mu metal or rare earth magnet and can be conveniently located inside a bow spring centralizer for protection. The magnet inside the liner can be movable and when positioned next to the external magnet structure, the two cooperate to generate the magnetic field in the annulus.

The portion of the liner comprising the injection ports typically has no other perforations and is conveniently formed from a non-magnetic material.

In accordance with a third aspect of the invention, there is provided a method for sealing an annulus surrounding a slotted liner in a well, comprising pumping a fluid comprising magnetized particles into the annulus in the region to be sealed at a rate sufficient to allow the magnetized particles to agglomerate and substantially fill the annulus in the region to be sealed.

The pumping rate and the viscosity of the fluid are selected such that the effect of the magnetized particles is to hold the fluid in place while the pumping takes place.

It is particularly preferred that a setting fluid is used, for example a hydraulic cement.

BRIEF DESCRIPTION OF THE DRAWINGS

FIG. 1 shows a slotted liner in accordance with an embodiment of the invention located in a well FIGS. 2*a*, 2*b* and 2*c* show details of the embodiment of FIG. 1;

FIGS. 3*a*, 3*b* and 3*c* show an alternative embodiment of the invention to that of FIG. 2;

FIG. 4 shows an embodiment of a placement tool for use in the method of the invention; and FIG. 5 shows a further embodiment of a placement tool.

DETAILED DESCRIPTION OF THE INVENTION

The present invention comprises the following techniques:

The CECP fluid is loaded with ferromagnetic particles. The fluid is guided in the annulus outside the liner by the magnetic field generated in the annulus.

The Ferro-magnetic fluid for the CECP is magnetized before the injection in the annulus. The internal fluid magnetism insures internal cohesion inside the fluid: the fluid has a tendency to minimize its external surface as being self-attracted. If external forces (gravity, flow) are limited, the preferred shape of a certain volume of that fluid would be a sphere. By virtue of this property, the CECP fluid entering in the annulus by a perforation (or a slot) would flow in a "quasi" spherical fashion from the perforation. This flow pattern insures proper filling of the annulus.

The two preceding techniques can be combined to improve the placement.

The ECP fluid, in this case a cement slurry is charged with ferromagnetic particles. One of the preferred fluids is the cement slurry as described in U.S. Pat. Nos. 4,691,774 and 4,802,534 (incorporated herein by reference). The size and aspect ratio of the magnetic material is carefully selected to (1) prepare a mixable slurry with an acceptable rheology, (2) provide a strong enough mechanical response to the magnetic field and (3) not separate out of the slurry when exposed to the magnetic field.

One particular magnetic additive suitable is gamma-Fe2O3 (commonly used in magnetic tape). The particle-size range is 0.5–1.0 microns. The particles are needle shaped so as to act as dipoles and align themselves longitudinally along the direction of magnetic flux. Depending on the slurry density, the concentration of the magnetic particles can vary from 5% to 10% BWOC. For a cement slurry which follows the principles described in EP 0 621 247, the magnetic particles can comprise the fine particle fraction.

FIG. 1 shows a horizontal section 10 of a well extending through a producing formation 12 and having a slotted liner 14 located therein. The liner is held in place by means of centralizers (not shown) positioned at various locations along its length, but is otherwise unconnected to the well. Consequently fluid can flow along the well inside the liner via the slots 16, or if there is a blockage or flow restriction around the outside in the annulus 18. At various locations along the liner 14, modified sections 20 are located (only one is shown here). These modified sections allow placement of magnetic fluids in the annulus so as to seal the annulus and force flow to pass through the liner.

The modified section 20 is shown in more detail in FIGS. 2*a*–2*c* and comprises a non-magnetic liner section 22 (e.g. stainless steel or reinforced composite materials). At about the mid point of the liner section 22, a series of ports 24 are provided which provide communication between the inside of the liner section 22 and the annulus 18. The remainder of the liner section 22 is solid. The liner section 22 is provided with a series of magnets 26 arranged around the outside of the liner section 22 and positioned on either side of the ports 24. These can be fixed directly to the liner section 22 as shown, or of mounted on modified scratchers or centralizers (not shown). These magnets 26 can be distributed at uniform angular position around the liner section 22 and comprise horseshoe magnets with facing open ends 28, 28'. The poles N, S are positioned so as to effectively form an annular magnetic field in the annulus 18 on either side of the ports 24. The magnets 26 can be installed in several rows at various distances from the ports 24, as shown. In a preferred arrangement, these magnets are symmetrical over the length versus the position of the injection port.

An alternative implementation is shown in FIGS. 3*a*–3*c*. In this case, the magnetization of the elements 30 attached to the outside of the liner 22 is generated by a magnet 32 located inside the liner 22 at the required position. During normal operation, the magnet 32 is not present: magnetization of the elements 30 disappears. This avoids any adverse effect during the installation of the completion, or during production (e.g. effects on logging and intervention tools, packing of metal particles, etc.).

The system shown in FIGS. 3*a*–3*c* achieves the same magnetic effect as that shown in FIGS. 2*a*–2*c*. However, this design has certain significant differences:

The magnet 32 inside the liner 22 can be removed by an appropriate retrieval tool.

The magnetic elements 30 which define the "magnetic circuits" can be formed from a high Mu metal or rare earth alloy (examples of such magnetic materials are available from Stanford magnets Company of California).

The external poles can be protected by a bow spring 34 which can also be used to centralize the liner 14. The Mu metal elements 30 can be attached to the spring 34.

The effect of the magnet 32 inside the liner 22 is to induce corresponding magnetic poles N, S in the elements 30 and so produce essentially the same magnetic field configuration as described in relation to FIGS. 2*a*–2*c*.

In use, the magnetic CECP fluid is placed using a coiled tubing unit (not shown), for example. The end of the coiled tubing 40 is equipped with two rubber cups to confine the fluid in a small liner volume and force it towards the injection ports 24 of the special liner 22. One cup 42 is installed around the tubing, while the other one 44 is blind and held at a short distance from the end of the tubing 40 inside the liner 22.

If removable magnets are used (not shown here), the cups 42, 44 are located and shaped to be compatible with their presence (and their installation). The installation and fishing of the magnet 32 can performed by a fishing tool (not shown) attached to the same tubing. This allows the placement of the CECP fluid in signal trip, and potentially the placement of several CECP's in one run. The fishing tool for the magnet 32 preferably closes the magnetic air gap when the magnet is not installed. This allows easy removal and transport of the magnet 32.

The special liner sections 22 are installed during the installation of the slotted liner 14. In the event that unwanted flow into the well commences, for example water breakthrough (arrow 1 in FIG. 1), the liner section 22 downstream of this flow is located and the annulus sealed at this point in the following manner (the following description relates to the embodiment of the invention shown in FIGS. 3*a*–3*c*; the same approach applies, mutatis mutandis, for the embodiment of FIGS. 2*a*–2*c*.):

A coiled tubing 40 is lowered in the hole with the two rubber cups 42, 44 and the magnet installation tool, loaded with the magnets 32 (not shown).

The magnets 32 are installed at the proper depth and proper azimuth to induce magnetic flux in the annular poles 30.

The cup sealing is insured around the injection ports 24 (one above 42, one below 44).

The ferromagnetic fluid is pumped through the coiled tubing 40 and pushed behind the liner 14 through the injection ports 24 of the special liner 22.

Annular flow is initiated. However, when the ferromagnetic fluid passes near the magnetic poles 30, it is attracted by these poles and "sticky" magnetic slurry balls build around the magnetic poles 30. These balls grow slowly and finally touch each other and form a toroid in the annulus. Once set, the slurry toroids will plug the annulus and force any flow to pass through the liner 22 at this point.

If the unwanted flow is from the lowest part of the well and no useful fluids are produced from this region, it may be sufficient merely to plug the well at this point using a packer or cement plug. Alternatively, if there is useful fluid production occurring upstream of the unwanted flow, a further such operation can be performed at the liner 22 upstream of this flow and a bridge plug or the like installed between the two annular seals to cut off the unwanted production and only direct the wanted fluids into the well.

A further embodiment of the invention does not use magnets at all. In this method, the fluid is similar to that described above. However, in this case, the metal particles are magnetized. Due to this distributed magnetism, attraction is generated between various particles in the fluid. Therefore, the magnetized slurry will act as if it has an extreme tension surface: when pumped slowly out of a relatively small pipe or orifice, it will grow a ball at the orifice. With this concept, a non-magnetic short liner with a few injection ports (essentially as described above) can be used for the injection of this fluid into the annulus. The placement technique will be similar to that described above (coiled tubing with two rubber cups). When the magnetized fluid flows slowly out of the liner injection port into the annulus, its apparent cohesion provokes the build-up of slurry in a "ball" shape behind the port. This ball grows until reaching the formation wall. As several ports are used in the same section, the multiple slurry balls grow to touch each other to form again a toroid in the annulus, while plugging it.

The magnetization of the particles can be performed by a strong magnetic flux. This is preferably performed at the bottom of the coiled tubing in a nonmagnetic section using a strong magnet properly installed outside the tubing. In the event that it is required that the particles stay a certain time under the flux with minimum movement to insure proper alignment of their poles, pumping may be very slow or intermittent.

An embodiment of such a system is shown in FIG. 5. The coiled tubing 50 has a non-magnetic stinger 52 with a magnetic circuit formed by a strong magnet 54 and a ferromagnetic closure bar 56. When the closure bar 56 is open, the magnetic field extends into the stinger and acts to magnetize the particles. When closed, the high flux inside the pipe is suppressed so as to allow flow of the fluid to recommence from time to time. The operation of the magnetic circuit closure bar 56 can be achieved by slight displacement of the tubing.

If electrical power is available at the bottom of the tubing, the magnetization can be performed via the electrical current activating a coil surrounding the tubing.

The previously described method can be used singly or in combination according to requirements.

What is claimed is:

1. A slotted liner comprising:

injection ports defined in a portion of the liner for injecting a fluid including magnetic particles into the annulus surrounding the liner; and multiple rows of magnets, on the outside of the liner, on either side of the region to be sealed for generating a magnetic field around the injection ports so as to confine the fluid to fill the annulus around the injection ports.

2. A slotted liner comprising:

injection ports defined in a portion of the liner for injecting a fluid including magnetic particles into the annulus surrounding the liner; and at least one magnet positioned inside the liner and moveable within the liner for generating a magnetic field around the injection ports so as to confine the fluid to fill the annulus around the injection ports.

3. A slotted liner comprising:

injection ports defined in a portion of the liner for injecting a fluid including magnetic particles into the annulus surrounding the liner; and at least one magnet positioned inside the liner and further an external magnet structure positioned outside the liner for generating a magnetic field around the injection ports so as to confine the fluid to fill the annulus around the injection ports.

4. A slotted liner as claimed in claim 3, wherein the external magnet structure comprises at least one magnet pole formed from a high mu metal.

5. A slotted liner as claimed in claim 3, wherein, when the magnet is positioned inside the liner near the external magnet structure, the two together define a "horseshoe" structure.

6. A slotted liner as claimed in claim 3, wherein the external magnet structure is located inside a centralizer spring.

7. A slotted liner as claimed in claim 3, wherein the portion of the liner comprising the injection ports is formed from a non-magnetic material.

8. A method for sealing an annulus surrounding a slotted liner in a well, comprising pumping a fluid comprising magnetized particles into the annulus in the region to be sealed and controlling the pumping rate and the viscosity-of the fluid such that the effect of the magnetized particles is to agglomerate and substantially fill the annulus in the region to be sealed and to hold the fluid in place while the pumping takes place.

9. A method as claimed in claim 8, further comprising magnetizing the particles before they are pumped into the annulus.

10. A method as claimed in claim 9, comprising magnetizing the particles inside the liner immediately before they are pumped into the annulus.

* * * * *